United States Patent [19]

Baggio et al.

[11] Patent Number: 4,841,649

[45] Date of Patent: Jun. 27, 1989

[54] LOCKING AND ADJUSTMENT DEVICE PARTICULARLY FOR SKI BOOTS

[75] Inventors: Giorgio Baggio, San Martino di Lupari; Mirko Baratto, Bigolino di Valdobbiadene, both of Italy

[73] Assignee: Nordica S.p.A., Montebelluna, Italy

[21] Appl. No.: 142,119

[22] Filed: Jan. 7, 1988

[30] Foreign Application Priority Data

Jul. 3, 1987 [IT] Italy ..... 82576 A/87

[51] Int. Cl.[4] ..... A43B 5/04; A43C 11/00

[52] U.S. Cl. ..... 36/117; 36/50; 36/119; 24/68 SK; 24/71.1

[58] Field of Search ..... 36/117-121, 36/50; 24/68 SK, 69 SK, 70 SK, 71 SK, 71.1, 71.2

[56] References Cited

U.S. PATENT DOCUMENTS

| | | | |
|---|---|---|---|
| 4,653,204 | 3/1987 | Morell et al. | 36/117 |
| 4,735,004 | 4/1988 | Dodge | 36/117 |
| 4,741,115 | 5/1988 | Pozzobon | 36/117 |
| 4,748,726 | 6/1988 | Schoch | 24/68 SK |
| 4,761,859 | 8/1988 | Calabrigo | 36/117 X |

*Primary Examiner*—James Kee Chi

*Attorney, Agent, or Firm*—Guido Modiano; Albert Josif

[57] ABSTRACT

The device includes a box-like body associated with a ski boot, an actuating knob rotatably associated with the body and acting on two winding spools adapted to wind traction elements, such as cables. The knob univocally controls the spools through mechanical reduction means. Means being furthermore provided to finely adjust the tensioning of at least one cable independently.

17 Claims, 3 Drawing Sheets

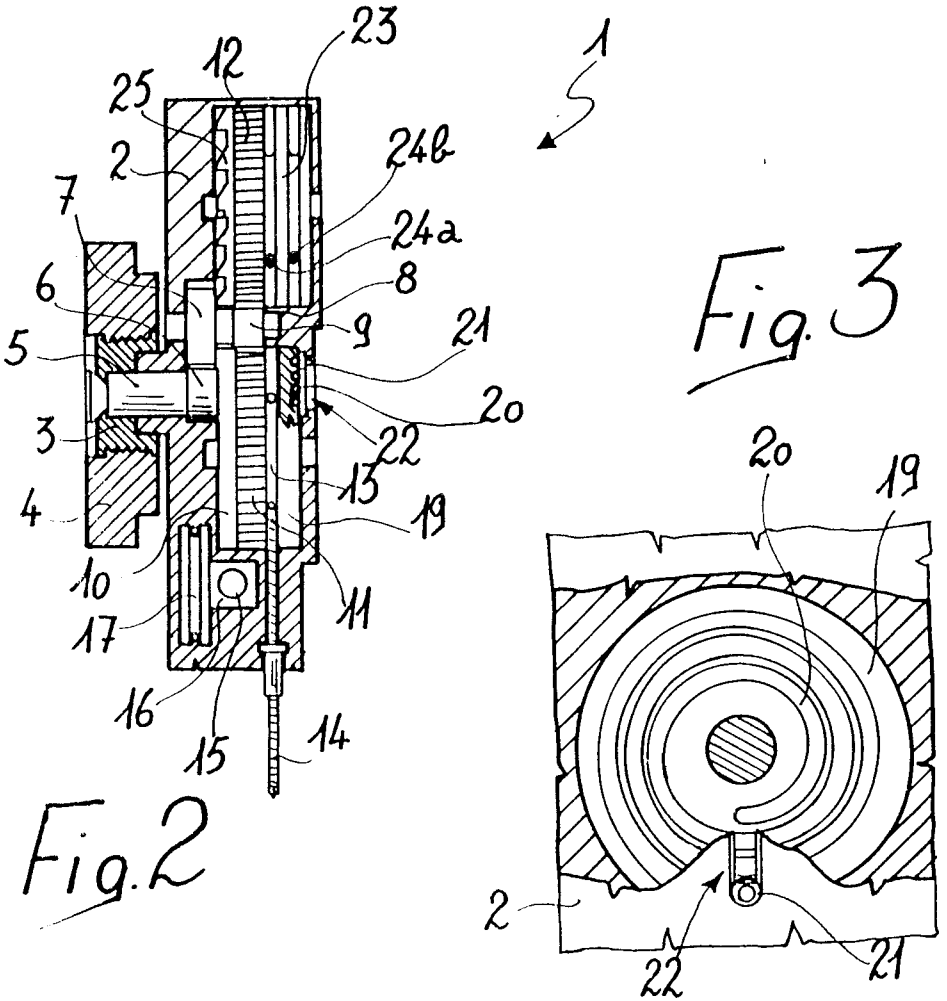
Fig. 2
Fig. 3
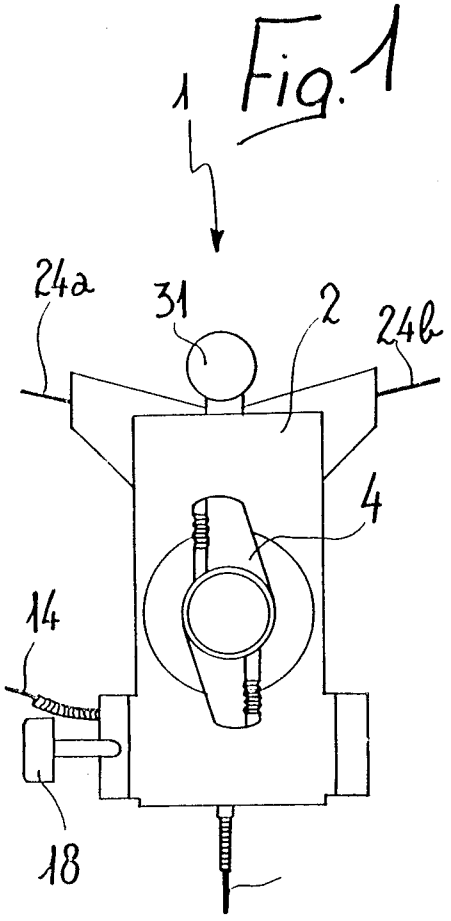
Fig. 1

LOCKING AND ADJUSTMENT DEVICE PARTICULARLY FOR SKI BOOTS

BACKGROUND OF THE INVENTION

The present invention relates to a locking and adjustment device particularly usable for ski boots of the rear-entry type.

Among known devices, suitable for example for fastening the quarters of a ski boot, U.S. Pat. No. 4,433,456 filed by the same Assignee discloses a closure device comprising a box-like body associated with a first boot portion and provided with a knob actuating a spool for winding at least one cable associated with another boot portion to be loosened or tightened relatively to the first boot portion.

The device furthermore comprises ratchet-gear means controlled by said knob, adapted to lock the spool in any position during the rotation of the knob in one direction and to unlock said spool upon the rotation of the knob in the opposite direction.

To reduce the locking effort, a reduction ratio is provided, while the stroke limit for winding the cable is obtained by means of a particular arrangement of the teeth.

Though said device is undoubtedly valid, it has some disadvantages, being structurally rather complicated, therefore constructively onerous, the range of transmission ratio being furthermore reduced since it is limited by dimensional requirements due to the particular structure of said device.

As a partial solution to these disadvantages, European Pat. No. 0 132 744, filed by the same Assignee, discloses a device for actuating a foot instep presser alone composed of an actuation element comprising a spool for winding a cable rigidly associated in rotation with a knob supported, with the possibility of rotation and axial translatory motion, by a fixed body associated with the shell.

Though said device is structurally simpler than the preceding one, it has a direct transmission which makes it suitable practically only for securing the foot presser, great efforts not intervening in this operation.

The device furthermore provides a stroke limit constituted by a tooth protruding from the knob, which interacts with an abutment on the fixed part of the support: this configuration however allows only one rotation of 360 degrees.

The same Assignee filed a U.S. Pat. No. 4,620,379 disclosing a closure device which allows the simultaneous locking of the quarters and of the foot.

This device, however, also has a disadvantage, the locking being the same both for the quarters and for the foot, this not being optimum since the two require separate adjustments.

A French patent application, No. 2570257 filed on Sept. 14, 1984, is also known, wherein a circular device is illustrated which effects a locking on the foot instep and of the quarters, said device winding a single cable acting thereon.

Among the disadvantages observable in said known type of device, it is noted that the locking occurs without differentiations between the foot instep and the quarters, furthermore, there is an insufficient rear support since, during the extension of the leg, the cable exerts a greater pressure on the foot instep and, vice versa, it tends to slacken the pressure when the skier flexes his or her leg, thus being ineffective in the conditions of actual stress.

The device furthermore provides the unlocking of the cable by means of a ratchet lever actuatable by the skier: however, when said lever is subject to high loads, that is to say for very tight lockings, the skier has to exert quite an effort and, furthermore, only the rapid unwinding of the cable is possible.

SUMMARY OF THE INVENTION

The aim of the present application is to eliminate the disadvantages described above in known types by providing a device allowing the simultaneous locking of the quarters and/or of pressers located, for example, at the instep and at the heel of the foot, in a rapid, simple manner and with modest efforts on the part of the skier.

Within the scope of the above described aim, another important object is to provide a device which allows to differentiate the degree of locking of the quarters and/or of the pressers.

A further object is to provide a device which allows to achieve an optimum grip of the boot for backward movements of the leg, keeping the locking of the quarters and/or of the presser in optimum conditions.

Still another object is to provide a device which allows to slacken the quarters and/or the pressers in a rapid and/or gradual manner according to the contingent requirements.

Not least object is to provide a device which associates with the preceding characteristics that of being structurally simple, scarcely bulky, reliable in use, and having modest costs.

The aim and the objects mentioned above, as well as others which will become apparent hereinafter, are achieved by a locking and adjustment device, particularly for ski boots, comprising a box-like body, associable with a ski boot, a first knob actuatable by the skier being rotatably associable to said body, the device further comprising a first and a second winding spool, for at least one traction element, pivoted freely to said box-like body and interacting with mechanical reduction means univocally controlled by said knob, means being provided for a fine adjustment of the tensioning of at least one of said traction elements.

Conveniently said first winding spool has means adapted to prevent the accidental winding thereon of said one or more traction elements beyond the point of maximum unwinding.

Advantageously said second winding spool has a toothed ring interacting with ratchet-gear means controlled by means selectively actuatable by the skier and adapted to lock and unlock said second spool during the rotation of said knob in one direction and in the opposite direction.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein:

FIG. 1 is a front view of the device;

FIG. 2 is a view according to a longitudinal middle sectional plane wherein, for the sake of clarity, the spools have not been sectioned;

FIG. 3 is a partially sectioned front view of the means adapted to prevent the accidental winding on the first spool of the traction elements beyond the point of maximum unwinding;

DESCRIPTION OF THE PREFERRED EMBODIMENTS

Figure 5:
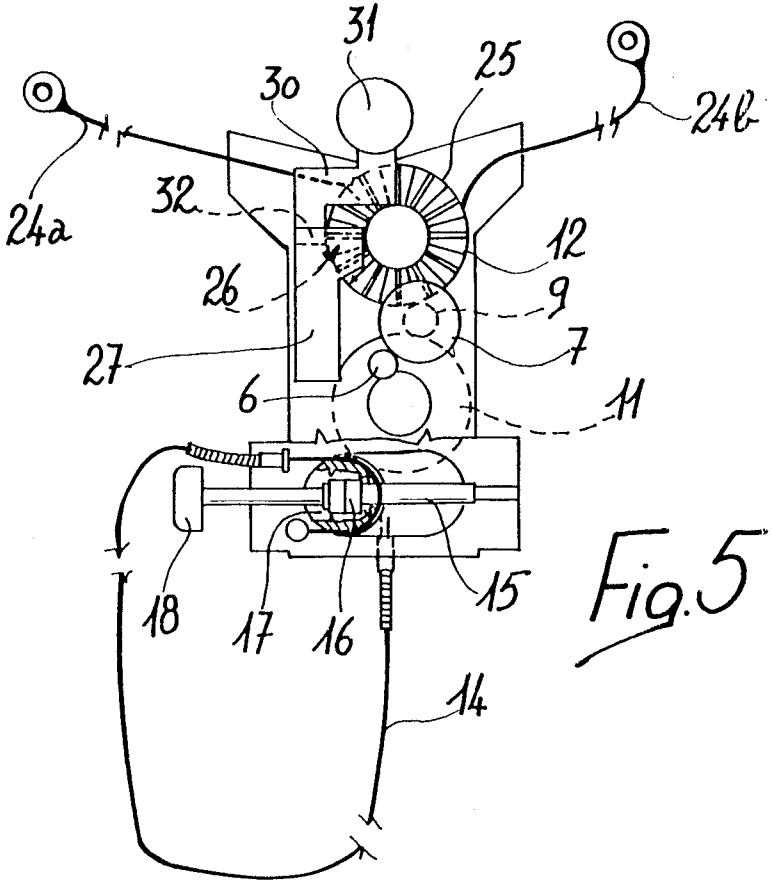
FIG. 5 is a view, similar to that of FIG. 1, of the device in partial cross section.
Figure 4:
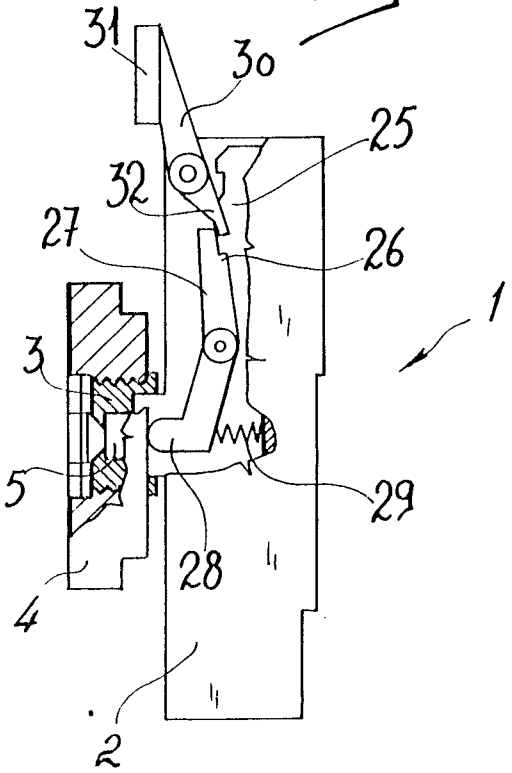
FIG. 4 is a partially sectioned side view of the device illustrating the ratchet-gear means.

With reference to FIGS. 1–5, the locking and adjustment device, generally indicated by the reference numeral 1, comprises a box-like body 2, associable with a ski boot, from which protrudes a ring 3, axially perforated and externally threaded, with which a first knob 4 is rotatably associated.

A stem 5, having at the end internal to said box-like body 2 a first toothed wheel 6, is coaxially associated to the knob 4 so as to rotate integrally therewith.

The toothed wheel 6 interacts with a second toothed wheel 7 keyed at a first pivot 8 freely pivoted internally to the box-like body 2, axially offset with respect to said stem 5.

The second toothed wheel 7 has a diameter preferably greater than that of said first toothed wheel 6.

To said first pivot 8 there is furthermore keyed a third toothed wheel 9 having a diameter smaller than that of said second toothed wheel 7 and being arranged at an adapted cavity 10 provided internally to the box-like body 2.

Said third toothed wheel 9 interacts simultaneously with a fourth and with a fifth toothed wheel indicated respectively by the numerals 11 and 12.

Said fourth toothed wheel 11 is keyed to a first winding spool constituted by a first pulley 13 freely pivoted internally to the cavity 10 of the box-like body 2.

An end of a traction element, such as for example a first cable 14 adapted for example to interact with an adapted presser placed internally to the boot at the foot instep and/or heel regions, is arrangeable inside said first pulley 13.

The other end of said first cable interacts with means for the fine adjustment of the tensioning thereof, said means being constituted by a threaded rod 15, rotatably associated with said box-like body 2 proximate to the end thereof from which the first cable 14 protrudes, with said threaded rod there being associated a complementarily threaded first pawl 16 whereto is freely pivoted a second pulley 17 around which the end of the first cable 14 not associated with the first pulley 13 is caused to pass.

The rotation is impartable to the threaded rod 15 by means of an adapted second knob 18 protruding externally to the box-like body 2.

With the first winding spool there is furthermore associated, on the opposite side with respect to the first knob 4, a flange 19, rigidly associated in rotation with the fourth toothed wheel 11, whereon a seat 20 having a helical configuration is provided.

A second pawl 21 is slideably accommodated within said seat 20 and is also slideable at the other end, within an adapted guide 22 provided at the box-like body 2 radially to said flange 19.

A second winding spool is keyed to the fifth toothed wheel 12 and is constituted by a pair of third pulleys 23 at each whereof there is associated the end of a traction element such as second cables 24*a* and 24*b* the other ends whereof are associated at the quarters of the boot.

On the opposite side with respect to said third pulleys 23, a ring 25 is associated with said fifth toothed wheel 12; the ring 25 has a front set of teeth interacting with the tooth 26 of a ratchet 27 pivoted to the box-like body 2 along an axis perpendicular to that of said fifth toothed wheel 12.

Said ratchet 27 has, at the end opposite to the one having the tooth 26, a lug 28 an end whereof interacts with the perimetral edge of the first knob 4 and the other with an elastically deformable element constituted by a spring 29 interposed between the same and the box-like body 2.

The lug 28 allows, by rotating the first knob 4, to disengage the tooth 26 from the ring 25.

To allow the rapid uncoupling between the ratchet 27 and the ring 25, a lever 30 is provided, pivoted internally to the box-like body 2 along an axis approximately parallel to the pivoting axis of said ratchet 27. The lever 30 has at one end a pushbutton 31 accessible to the skier, and at the other end a tab 32 interacting with the ratchet 27 and adapted to disengage the tooth 26 thereof from the ring 25 once the pushbutton 31 is pressed.

Naturally the ratchet 27 and the ring 25 have sets of teeth adapted to allow the rotation of said first knob 4 in the direction of winding for the first pulley 13 and third pulleys 23, but preventing the rotation thereof in the direction of unwinding.

The use of the device is thus as follows: the skier, by imposing a rotation to the first knob 4 in the direction of winding of the first and of the second cables 14 and 24, imposes simultaneously the locking of the quarters and of pressers arranged at the foot instep and heel regions.

This locking is easy due to the presence of the mechanical reduction means constituted by the toothed wheels 6, 7, 9, the wheel 9 interacting directly with the wheels 11 and 12 actuating the first and the second winding spool.

The second knob 18 contributes to differentiate the tensioning among the cables 24*a*, 24*b*, and 14 and, for example once the selected degree of locking of the quarters is achieved, allows the further fine adjustment of the tensioning of the cable 14.

If the user wishes to unlock the pulleys 13 and 23 he may act in two separate manners.

The first consists of pressing the pushbutton 31 of the lever 30, obtaining the rapid uncoupling between the tooth 26 of the ratchet 27 and the ring 25.

Alternately said uncoupling can occur in a slower manner by rotating the knob in the direction opposite to the unwinding one: by doing this it will shift slightly at the ring 3 causing in turn the shifting of the lug 28 and then lifting the tooth 26 from the ring 25.

The presence of the flange 19 with the related pawl 21 slideable within the seat 20 prevents the cable 14 from being unwound beyond the point of maximum unwinding.

It has thus been observed that the invention achieves the intended aim and objects, a device having been obtained which, besides allowing the simultaneous locking, for example, of the quarters and/or of pressers arranged at the instep and at the heel of the foot, also allows to differentiate the degree of locking of said quarters and/or pressers.

The mechanical reduction means constituted by the toothed wheels 6, 7 and 9 furthermore provides a rapid and effortless locking on the part of the skier, yet attaining high tensionings.

The device furthermore provides the boot with optimum support upon rearward movements of the leg, the locking of the quarters and/or of the pressers remaining in an optimum condition, thus ensuring a perfect transmission of the forces from the foot to the boot and thus to the ski.

The possibility of obtaining the unlocking according to two different manners increases the functionality of the device and therefore its practical use.

The device is furthermore structurally very simple, having very small dimensions, thus increasing the possible arrangements on the boot.

Naturally the invention thus conceived is susceptible to numerous modifications and variations, all of which are within the scope of the same inventive concept.

Figure 8:
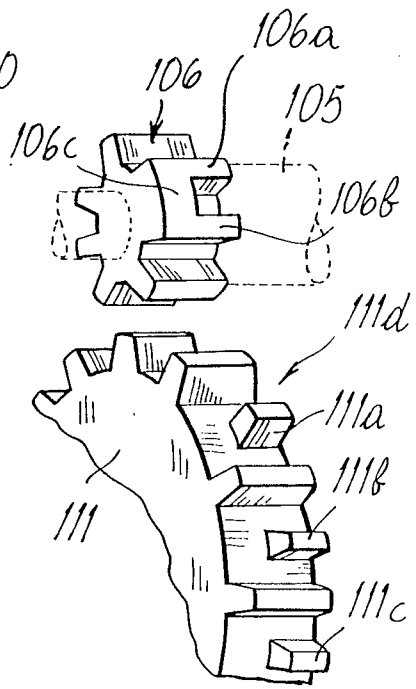
FIG. 8 is an exploded perspective view of the stop end assembly of the device of FIGS. 6 and 7.
Figure 6:
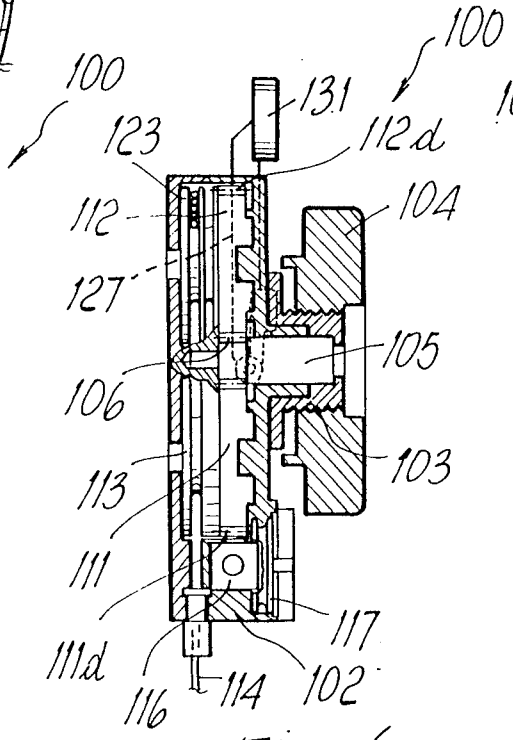
FIG. 6 is a side view, sectioned according to a longitudinal middle plane of a device according to another aspect of the invention.
Figure 7:
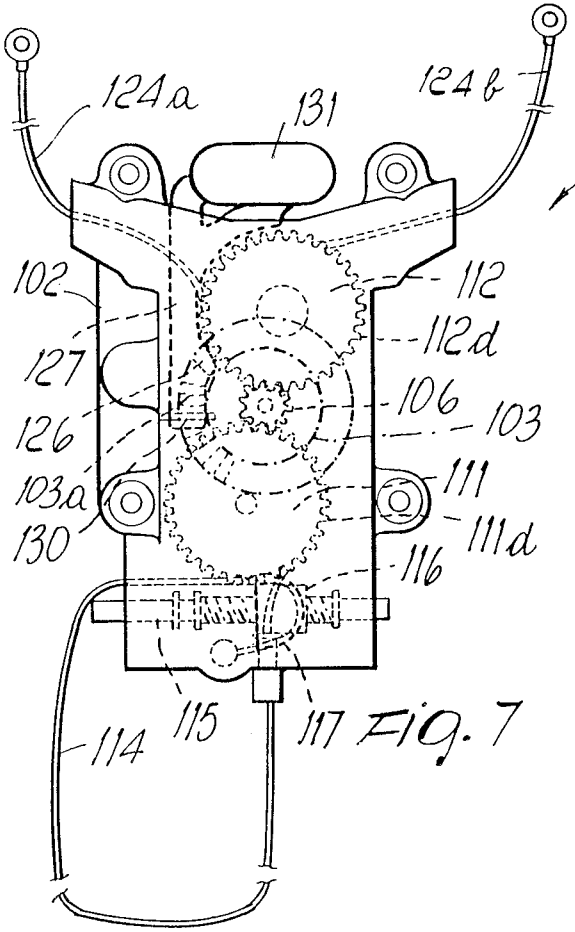
FIG. 7 is a partially sectioned front view of the device of FIG. 6.

As illustrated in FIGS. 6–8, a device 100, according to another aspect of the invention, comprises a body 102 associable to a ski boot and from which protrudes an externally threaded ring 103 associated to a knob 104, in a manner fully similar to what has been described above.

The device 100 also comprises a first pulley 113, coaxially associated to a first toothed wheel 111, and a second pulley 123 coaxially associated to a second toothed wheel 112, adapted to wind traction elements as described above.

A pinion 105 is coaxially associated to the knob 104 and has a toothed end wheel 106 engaging both a first wheel 111 and a second wheel 112; thus the rotation of the knob 104 controls the winding of the traction elements 124*a*, 124*b* and 114, the pinion 105 and the wheels 111 and 112 having a suitable reduction ratio.

The traction element 114 is advantageously a cable acting on a foot presser and is provided with means for the fine adjustment of its tensioning comprising a threaded rod 115, associated with the body 102, supporting a threaded pawl 116 carrying a small pulley 117 engaging the cable. By turning the rod 115 the pulley 117 is displaced varying the working length of the cable as described above.

The device is provided with a locking/unlocking means of the pulleys' rotation comprising a flange 103*a* formed on the ring 103 and provided with a frontal set of teeth. The flange 103*a* engages a tooth 126 of a ratchet 127. The ratchet 127 is pivoted at a pivot 130 associated with the body 102 and has a pushbutton 131 which is located outside the body 102.

Elastic means (not illustrated in the drawings) bias the ratchet 127 to engage the flange 103*a*; the set of teeth of the flange 103*a* and the tooth 126 of the ratchet 127 are shaped so as to allow a rotation of the knob 104 in the direction of winding of the pulleys and to prevent a rotation in the direction of unwinding.

An end stop assembly is also provided to prevent the pulleys from rotating beyond the point of maximum unwinding and thus winding the cables in a direction opposite to the designed one.

The end stop assembly comprises a set of teeth 106 provided on the pinion 105 and having a partially filled interspace 106*c* between the teeth 106*a* and 106*b*. The set of teeth 106 of the pinion 105 engages the toothed wheels 111 and 112 respectively provided with set of teeth 111*d* and 112*d*.

The toothed wheels 111 and 112 are similar and only the toothed wheel 111 is illustrated in FIG. 8 and described.

The set of teeth 111*d* of the wheel 111 has trimmed teeth 111*a*, 111*b*, 111*c* adapted to couple with the interspace 106*c* of the pinion set of teeth 106 allowing a rotation of the pinion 105 and wheels 111 and 112. At a point of maximum unwinding of the cables, the partially filled interspace 106*c* engages a complete tooth of the wheels' set of teeth preventing any further rotation.

The trimmed teeth 111*a*, 111*b*, 111*c* may be of any number and may have different location depending on the number of turns deemed for the pulleys 113 and 123 to be sufficient to wind a suitable length of cable.

The operation of the device 100 is substantially similar to what has been described before; in this case the locking/unlocking means requires a reduced effort to press the push button 131 to release the cables.

Furthermore the device 100 has an even more simple and lightweight structure which is nevertheless very sturdy and reliable.

The materials, as well as the dimensions constituting the individual components of the device, may also be the most pertinent according to the specific requirements.

We claim:

1. A locking and adjusting device, particularly for ski boots of the type having a substantially rigid shell and a plurality of movable portions including at least a pair of movable quarters and one movable foot presser, said device comprising:

a box-like body rigidly associated with a ski boot;

one first flexible traction element arranged to a first movable foot presser;

at least one second flexible traction element arranged to actuate a respective movable quarter of the boot;

a first spool freely pivoted to said box-like body internally thereof for winding said first flexible traction element;

a second spool freely pivoted to said box-like body internally thereof for winding said at least one second flexible traction element;

mechanical transmission means located internally of said box-like body for simultaneously driving said first and said second winding spools; - a first control knob rotatably mounted externally of said box-like body for operating said mechanical transmission means;

tension adjustment means for finely adjusting the tension exerted on at least one of said first and said second flexible traction elements;

whereby rotation of said first knob is simultaneously transmitted with a reduced effort of the skier to said first and said second winding spools to thereby univocally adjust the tension exerted on said first and at least one second flexible traction element, and whereby operation of said tension adjustment means allows said first and said at least one second flexible traction elements to be locked at different tension values.

2. A locking and adjustment device according to claim 1, wherein said mechanical transmission means include a stem turnably supported internally of said box-like body and having one end thereof extending at least partially externally of said box-like body, said outer end of said stem being operatively connected with said first control knob, the inner end of said stem being provided with a first toothed wheel.

3. A locking and adjustment device according to claim 2, wherein said mechanical transmission means further include a first pivot rotatably mounted in said box-like body, parallel and axially offset with respect to said first stem, said first pivot having at one end thereof a second toothed wheel with a diameter greater than that of said first toothed wheel and in mesh engagement therewith, at the other end of said first pivot there being keyed a third toothed wheel having a diameter smaller than that of said second toothed wheel.

4. A locking and adjustment device according to claim 3, wherein said mechanical transmission means further include a fourth toothed wheel rigidly and coaxially associated with said first winding spool and a fifth toothed wheel rigidly coaxially associated with said second winding spool, said fourth and said fifth wheel having both a diameter greater than that of said third toothed wheel of said first pivot and being in mesh engagement with said third toothed wheel.

5. A locking and adjustment device according to claim 2, wherein said first knob has an axial through hole which is partially internally threaded, a ring being rigidly associated with said outer end of said stem, said ring being externally threaded complementary to said partially internally threaded through hole for partial screwing internally thereof, whereby said first control knob is allowed to initially freely rotate in a first direction corresponding to a winding rotation of said first and said second winding spool and to axially move with respect to said stem and away from said box-like body to a limited extent, further rotation of said first control knob in said first direction causing rigid rotatable connection thereof with said stem.

6. A locking and adjustment device according to claim 1, further comprising locking means including a frontally toothed flange rigidly associated with said second winding spool, and further including controllable ratchet means arranged internally of said box-like body and selectively interengaging with said toothed flange so as to permit rotation of said second winding spool in a direction of winding said at least one second traction element and to lock said winding spool in an unwinding direction, control means being arranged externally of said box-like body for operating said ratchet means to thereby selectively lock and unlock said second winding spool.

7. A locking and adjustment device according to claim 5, wherein said toothed flange comprises a set of teeth formed on said second winding spool frontally thereof, said ratchet means comprising a first lever pivotet to said box-like body and having at one end a ratchet tooth selectively interengaging with said teeth of said toothed flange, spring means biasing the other end of said lever so that said ratchet tooth is normally urged against said toothed flange, said control means comprising a second lever pivoted to said box-like body and having one end provided with a pushbutton accessible from the outside of said box-like body, the other end of said second lever interengaging with said first lever in such a manner that operation of said pushbutton causes said ratchet tooth to disengage from said set of teeth thereby unlocking said first winding spool.

8. A locking and adjustment device according to claim 7, wherein said first knob has a substantially planar end face adjacent to said box-like body, said first lever of said ratchet means having a lug formed at the end thereof opposite to said ratchet tooth, said lug at least partially projecting outwardly of said box-like body proximately to said substantially planar surface of said first knob, whereby upon rotation of said knob in an unwinding direction, said knob is caused to axially move towards said box-like body so as to urge said planar end surface thereof against said projecting lug thereby actuating said first lever and causing disengagement of said ratchet tooth from said set of teeth to provide unlocking of said first winding spool.

9. A locking and adjustment device according to claim 1, wherein said first winding spool comprises a first pulley, said first flexible traction element having one end portion affixed to said first pulley to be wound therearound, the other end portion of said first traction element being associated with said movable foot presser of said boot.

10. A locking and adjustment device according to claim 1, wherein said second winding spool comprises a pair of second pulleys mutually associated side by side, there being provided a pair of second flexible traction elements each having one end affixed to a respective pulley of said pair for being wound therearound and another end associated with respective movable quarters of said boot.

11. A locking and adjustment device according to claim 1, wherein said tension adjustment means comprises a threaded rod turnably mounted in said box-like body while being prevented to axially move, said rod having a first outer end connected to a second control knob, an internally threaded pawl being threadably engaged with said threaded rod, a return pulley being fixed on said pawl for rotation about an axel substantially perpendicular to the axis of said threaded rod, said first traction element having one end affixed to said box-like body sideways to said rod and being partially turned around said return pulley, so that rotation of said second control knob causes said pawl to displace lengthwise of said threaded rod to allow fine tension adjustment of said first traction element.

12. A locking and adjustment device according to claim 1, wherein at least one of said first and said second winding spools has stop means to prevent accidental winding of a respective traction element beyond the point of maximum unwinding.

13. A tensioning and locking device, particularly for ski boots of the type having a substantially rigid shell movably supporting at least one inner foot presser and a pair of quarters, said device comprising a box-like body fixed to said boot shell, a first traction cable for actuating said at least one foot presser, a second traction cable for actuating one first movable quarter, a third traction cable for actuating a second movable quarter, a first winding spool for winding said first traction cable, a second winding spool for simultaneously winding said second and said third traction cables, mechanical transmission means for simultaneously driving said first and said second winding spool, a first control knob for operating said mechanical transmission means, wherein said mechanical tansmission means comprise a pinion partially supported internally of said box-like body, said pinion having an outer end connected to said first control knob and the other end toothed to form a first toothed wheel, a second toothed wheel being coaxially associated with said first winding spool, a third toothed wheel being coaxially associated with said second winding spool, said second and said third toothed wheels having a diameter smaller than that of said first toothed wheel and being in mesh engagement therewith, and wherein said device further comprises controllable ratchet means interengageable with at least one of said first and second winding spool to allow rotation thereof in a winding direction of said first and at least one second traction cables while preventing accidental unwinding thereof, whereby rotation of said operating knob is simultaneously transmitted with a reduction ratio to said first and said second winding spools in said winding direction to thereby univocally lock said first and said at least one second traction cable in any desired position.

14. A tensioning and locking device according to claim 13, wherein said ratchet means comprise a wheel having front serrations rigid with said second winding spool and a first toothed lever pivoted internally of said box-like body and arranged to engage said front serrations, spring means acting on said toothed lever so as to normally urge it against said serration to thereby locking said winding spool against rotation in an unwinding direction while allowing free rotation thereof in a winding direction, said ratchet means further comprising control means operable by the skier and acting on said ratcheted lever so as to disengage it from said serrated wheel thus unlocking said winding spool upon rotation thereof in an unwinding direction.

15. A tensioning and locking device according to claim 14, wherein said control means comprises a second lever pivoted internally of said box-like body and partially protruding internally thereto, the outer end of said second lever being provided with a pushbutton, the inner end of said second lever being arranged to interengage with said first toothed lever in such a manner that operation of said pushbutton causes said first toothed lever to engage said serrated flange.

16. A tensioning and locking device, according to claim 13, further comprising tension adjustment means including an externally threaded rod rotatably supported at least partially inside said box-like body while being prevented to move axially with respect thereto, a second knob connected to an outer end of said threaded rod, an internally threaded pawl threadably engaging said externally threaded rod, a return pulley being pivoted to said pawl with a rotation axis substantially perpendicular to said threaded rod, said first traction element having one end fixed to said box-like body and being partially turned around said return pulley for being finely adjustably tensioned therefrom upon displacement of said return pulley imparted by rotation of said second control knob.

17. A tensioning and locking device according to claim 13, further comprising stop means for preventing accidental winding of said first, said second and said third traction cables beyond the point of maximum unwinding thereof, said stop means including one partially filled interspace between two consecutive teeth of said first toothed wheel, the crown of teeth of said second toothed wheel comprising a first plurality of trimmed teeth and a second plurality of complete teeth, said set of trimmed teeth being arranged to engage said partially filled interspace of said first wheel and being located in selected position with respect to said set of complete teeth such that, upon complete unwinding of said second and third traction cables from said second winding spool, said partially filled interspace entangles one complete tooth of said second plurality thereby preventing further rotation of said first, second and third toothed wheels.

* * * * *

UNITED STATES PATENT AND TRADEMARK OFFICE

CERTIFICATE OF CORRECTION

PATENT NO. : 4,841,649

DATED : June 27, 1989

INVENTOR(S) : Giorgio Baggio, et al

It is certified that error appears in the above-identified patent and that said Letters Patent is hereby corrected as shown below:

On the title page:

Change item [30] to read as follows:

--Foreign Application Priority Data

July 3, 1987 (IT) Italy.....82567 A/87--

Signed and Sealed this

Third Day of July, 1990

*Attest:*

HARRY F. MANBECK, JR.

*Attesting Officer*

*Commissioner of Patents and Trademarks*